US005451972A

United States Patent [19]

Franklin

[11] Patent Number: 5,451,972

[45] Date of Patent: Sep. 19, 1995

[54] SATELLITE ANTENNA DISH COVER

[75] Inventor: Sharon E. Franklin, Ozark, Ark.

[73] Assignee: Paul Dean Franklin, Ozark, Ark.

[21] Appl. No.: 241,507

[22] Filed: May 12, 1994

[51] Int. Cl.[6] ..... H01Q 19/12

[52] U.S. Cl. ..... 343/840; 343/872

[58] Field of Search ..... 343/840, 872; 52/149, 52/222; 35/9; 383/74, 75, 72; 242/388.1, 395; 254/222, 223

[56] References Cited

U.S. PATENT DOCUMENTS

| | | | |
|---|---|---|---|
| D. 304,454 | 11/1989 | Serres | D14/231 |
| 810,795 | 1/1906 | McPherson | 254/223 |
| 2,366,299 | 1/1945 | Benschoten | 242/395 |
| 3,351,947 | 11/1967 | Hart | 343/840 |
| 3,388,401 | 6/1968 | Weir | 343/872 |
| 3,599,218 | 8/1971 | Williamson et al. | 343/872 X |
| 3,740,755 | 6/1973 | Grenzeback | 343/840 |
| 4,260,003 | 4/1981 | Hendrickson | 383/72 |
| 4,293,862 | 10/1981 | Beavers | 343/872 |
| 4,804,972 | 4/1989 | Schudel | 343/840 |

OTHER PUBLICATIONS

Patio Sales, Oct 11, 1960, p. 15 bottom right, Pool Covers (cited in Des. 304,454,D6/610).

TVRO Dealer, Jul. 1990, p. 42 ClearSat.

*Primary Examiner*—Donald Hajec

*Assistant Examiner*—Tho G. Phan

*Attorney, Agent, or Firm*—Robert R. Keegan

[57] ABSTRACT

There is disclosed a flexible fabric cover for a satellite antenna dish having an opaque, optionally decorated, front surface which serves to conceal the antenna dish; the cover is preferably formed of a generally circular piece of a synthetic fabric which is at least moderately stretchable, which is from six inches to two and one-half feet greater in diameter than the antenna dishes it is intended to cover, and which has a central opening for the antenna receiver and feed structure; the cover includes securing means in the preferred embodiment consisting of a peripheral hem having threaded therein a drawstring or drawcord such that the cover may be placed over the antenna dish with drawstring relaxed and the drawstring then tightened by employment of an optional tightening device capturing the rim of the dish with the hem to fasten the cover securely over the dish.

15 Claims, 4 Drawing Sheets

SATELLITE ANTENNA DISH COVER

BRIEF SUMMARY OF THE INVENTION

The present invention relates to covers for satellite communication antennas, and particularly such covers which are intended to alter the physical appearance of the antenna, either in a decorative manner or in a manner to make the antenna less obtrusive. Such covers must not interfere with a radio signal being received (or transmitted) in any substantial degree. The antenna cover of the present invention not only allows transmission of radio signals without significant loss, but provides a substantial degree of performance enhancement under certain weather conditions such as snow or icing.

The present invention in its preferred embodiment comprises a generally circular sheet of suitable fabric material, preferably having a central opening to accommodate a conventional antenna receiver and feed unit. The circular sheet is provided with a hem around its periphery which encloses a heavy drawstring or drawcord. The stretchability and flexibility of the material is such that the cover may be placed over the face of the antenna dish with the antenna feed passing through the opening in the center of the cover and with the periphery of the cover extending beyond the edges of the antenna dish preliminarily to pulling the drawcord tight and causing the drawcord and hem of the cover to capture the edge of the dish to firmly secure the cover; a spool and ratchet, pull-tite or any suitable means may be provided to facilitate the tightening of the drawcord and securing it until one desires to loosen the cord and remove the cover.

The primary use for covers according to the invention is thought to be for home satellite communication receivers, but such covers may also find use for satellite receivers used in commercial or other applications.

The manner of securing the cover on the dish makes it relatively easy to remove the cover for any reason, and this provides the advantage that decorative covers for the antenna may be designed with seasonal or holiday motifs and changed during the year to appropriately coordinate with the season. Use of the cover or covers permits the home owner to employ a satellite antenna on the home premises without going to great effort or expense to "hide" the antenna dish. Whereas covers according to the invention are primarily intended for use with existing antenna dishes from four feet to eleven feet in diameter, smaller covers may be found desirable as the size of parabolic antenna dishes may be reduced through technological advances.

Because of the configuration of the cover and the stretchability of the fabric which is used for the cover, a small number of cover sizes can be used for the considerable variety of antenna dish sizes which are in use. For example, a twelve foot decorative cover will cover dishes of eleven, ten, nine and eight feet in diameter, and an eight foot decorative cover will cover antenna dishes of seven, six, five and four feet in diameter, thus providing covers for virtually all satellite antenna dishes which have been manufactured over the last two decades.

BACKGROUND OF THE INVENTION

Parabolic antennas have been in use for many decades where they have been employed for uses other than home television reception from communication satellites. In uses for other than home television, a variety of forms of covers have been developed for parabolic antennas, mostly for protection against adverse weather conditions. Such covers have typically been made of rigid plastic material with a spherical or parabolic shape completely enclosing the face of the parabolic antenna including the feed structure located near the focus of the parabola. Examples of such antennas are disclosed in the patent to J. S. Hart, dated Nov. 7, 1967, U.S. Pat. No. 3,351,947, (U.S. Cl. 343—840) and the patent to Grenzeback, dated Jun. 19, 1973, U.S. Pat. No. 3,740,755, (U.S. Cl. 343/840).

Rigid covers have also been employed where the antenna feed structure extends through an opening in the center of the cover as illustrated in the patent to Schudel, dated Feb. 14, 1989, U.S. Pat. No. 4,804,972 (U.S. Cl. 343/840).

Also, covers have been known for parabolic antennas which were formed of a relatively flexible tarpaulin-like sheet preferably of rubberized material such as "Hypalon". This structure included a pressurizing or pressure equalizing arrangement to prevent wind induced vibrations and damaging of the "radar member or cover" as shown in the patent to W. F. Weir, dated Jun. 11, 1968, U.S. Pat. No. 3,388,401 (U.S. Cl. 343—872).

Generally such prior parabolic antenna covers are intended only to provide protection against weather rather than providing for decoration of or concealment of the antenna dish, but the patent to Schudel briefly mentions a possibility of forming the disclosed rigid, convex cover with optically transparent or translucent material with advertising or other information thereon.

None of these parabolic antenna covers or other known antenna covers are appropriate to provide an easily emplaceable and easily removable flexible, decorative cover for typical home television antenna dishes in the manner of the present invention.

In addition to providing the advantages and features described above, it is an object of the present invention to provide a cover of flexible sheet material for a satellite communication antenna which has a provision for accommodating a projecting central antenna feed in the form of a central opening and which comprises an enclosed, peripheral cord so that when the cover is placed on a satellite antenna dish with the edges of the cover overlapping the edges of the dish and the cord is drawn tight and secured, the cover is thereby firmly attached over the face of the antenna dish.

It is another object of the present invention to provide a cover for a satellite antenna dish of flexible fabric material having a decorative design formed thereon and including means for securing the generally circular cover at its edges to the edge of the antenna dish so that the dish from its face side is concealed by the decorative cover.

It is still another object of the present invention to provide a decorative cover for a satellite antenna dish formed of moderately stretchable polyester fabric with a peripheral hem through which is threaded a cord having its two ends extended through an opening in the hem and connected to a manually operated tightening and locking mechanism for drawing and maintaining the cord taut to capture the edges of a satellite dish and secure the cover thereon.

DESCRIPTION OF THE DRAWINGS

Other objects and advantages of the invention will be apparent from consideration of the following description in conjunction with the appended drawings in which.

DETAILED DESCRIPTION

Figure 1:
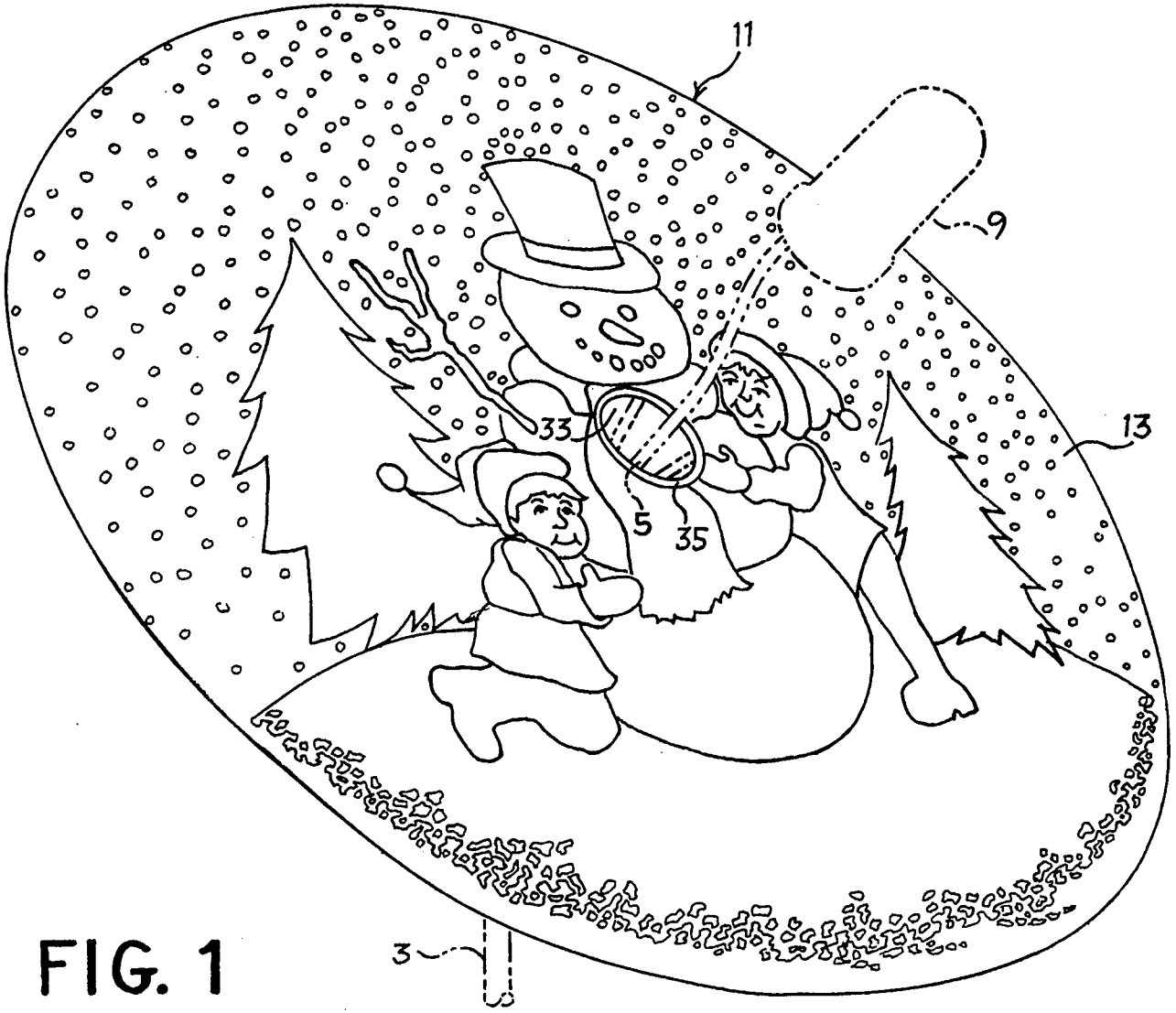
FIG. 1 is a front perspective view of a satellite antenna dish cover according to the invention placed on a satellite antenna dish (shown in phantom lines)

Referring to the drawings and particularly to FIG. 1, there is shown a cover 11 for a satellite antenna dish as the cover would appear when emplaced on an antenna dish. The components associated with the satellite receiver antenna dish shown (in phantom lines) in FIG. 1 include an upright support member 3, an antenna feed support element 5 and an antenna receiver feed housing 9. It will be understood that the structures of the various antennas with which the satellite antenna cover of the invention may be used form no part of the invention and are shown so that the features and advantages of the satellite antenna cover of the invention may better be explained.

As seen in FIG. 1, the cover 11 is secured on an antenna dish with a decorated fabric circle 13 thereof substantially covering the face of the antenna. Visible in FIG. 1 is a central opening 33 sufficiently large (approximately 12 inch diameter) to pass over the antenna feed housing 9 without dismantling the antenna; the opening 33 preferably is bordered with a binding 35 of fabric similar to the fabric of the cover proper 13 or of some other suitable sheet material.

Figure 2:
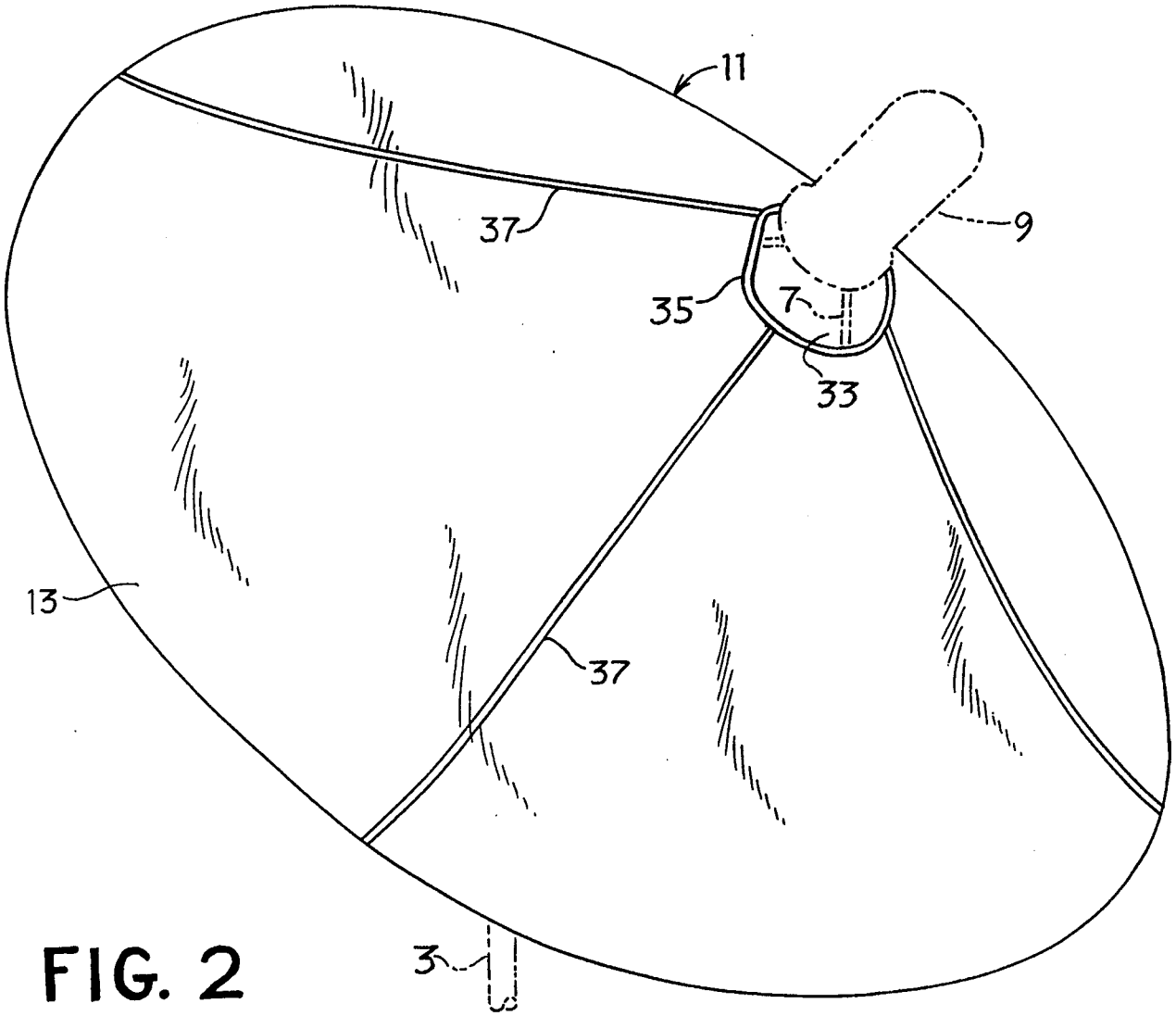
FIG. 2 is a perspective view of a satellite antenna dish cover according to the invention placed on a form of satellite antenna dish different from that shown in FIG. 1.
Figure 3:
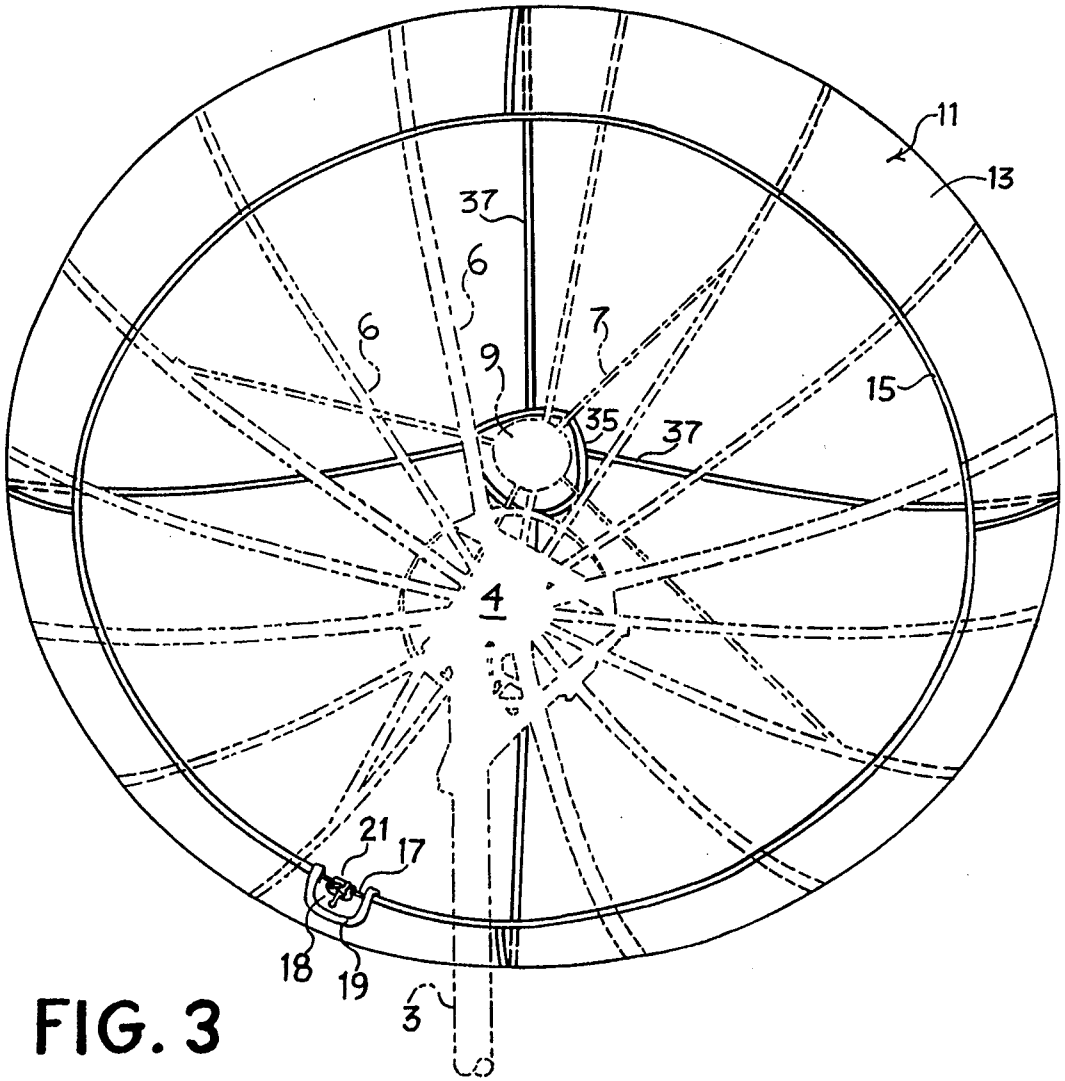
FIG. 3 is a rear perspective view of the satellite antenna cover on the satellite antenna dish (shown in phantom lines) of FIG. 2.
Figure 4:
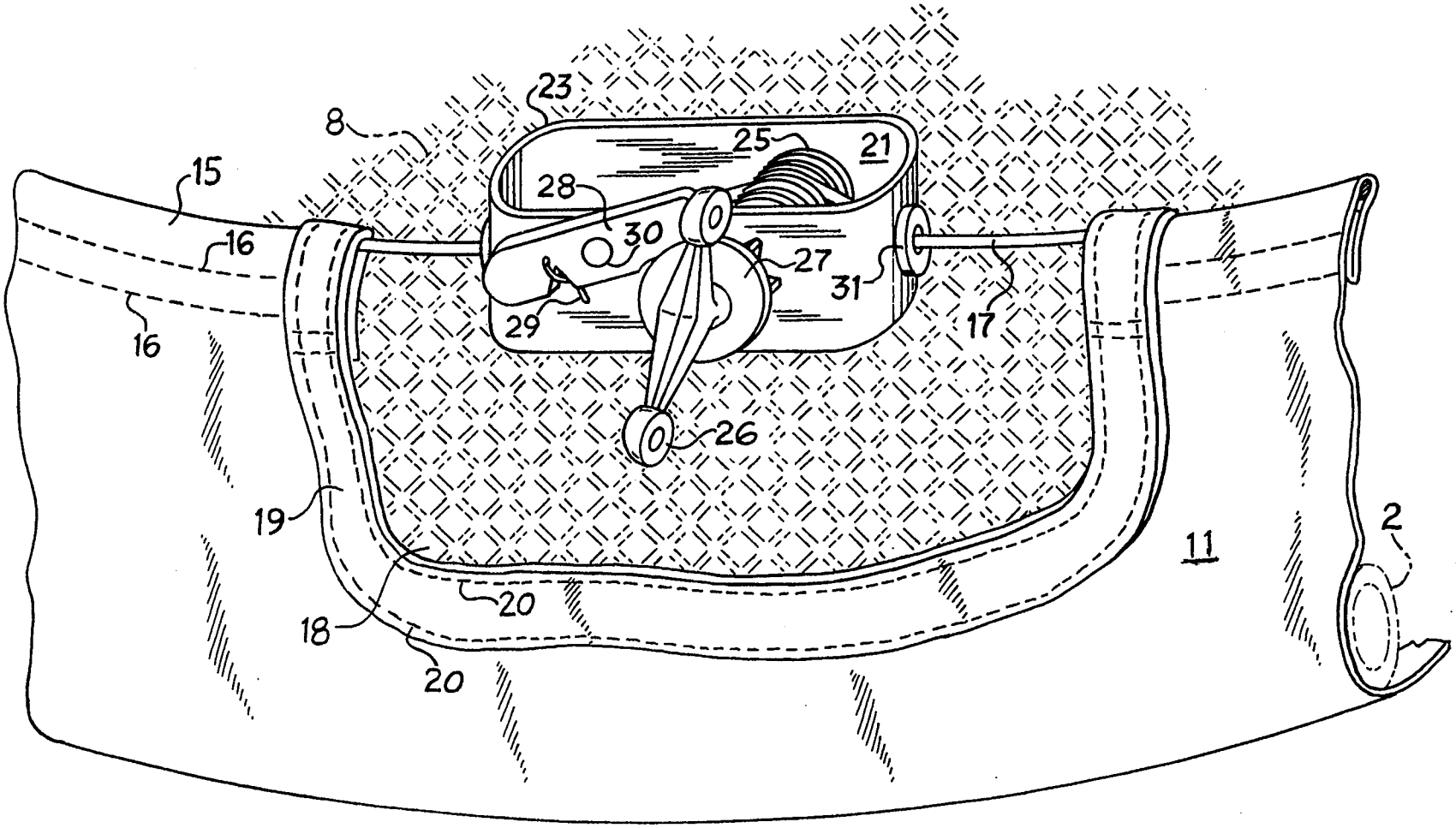
FIG. 4 is an enlarged detailed fragmentary view of the antenna cover of FIGS. 1, 2 or 3 showing the peripheral hem, drawcord and tightening mechanism for securing the cover.

The details of the satellite antenna cover 11 are more clearly shown in FIGS. 2, 3 and 4, which illustrate it in place on a slightly different form of satellite antenna structure. The satellite antenna dish and structure illustrated in FIGS. 2, 3 and 4 also includes a support element 3 of conventional form while the antenna dish includes a circular tubing element 2 together with a plurality of radial ribs 6 which radiate from the center of the satellite antenna structure 4 and, in conjunction with a metal grid 8 or other conductive material secured to and supported by ribs 6, are configured to provide a parabolic radio wave reflector for the antenna.

The structure of the satellite antenna shown in FIGS. 2, 3 and 4, like that shown in FIG. 1 is strictly conventional and does not form a part of the present invention. Although there are substantial variations in the million or more of such antennas in use, they are, with few exceptions, of circular shape in their overall configuration and are formed in a concave dish shape, generally of shallow, parabolic form. Typically the satellite antenna dish will have an antenna feed element such as antenna feed housing 9 supported centrally and at a short distance in front of the concave surface of the dish either by a single support element such as support element 5 in FIG. 1 or multiple-support elements 7 arranged as a tripod or quadrapod as shown in FIGS. 2, 3 and 4.

It should be noted that the satellite antenna cover 11 according to the invention, when secured on the satellite antenna dish as shown in FIG. 1 assumes a substantially flat surface shape with the antenna feed support element 5 extending through the opening 33. On the other hand, in FIGS. 2, 3 and 4 generally only the antenna receiver feed housing 9 extends through the opening 33 and the cover fabric surface 13 assumes a generally conical or pyramidal shape determined by the multiple antenna feed support elements 7. A desirable feature of the cover design, together with the stretchability of the fabric preferably used in its manufacture, makes it possible for the same configuration of satellite antenna cover 11 to be equally well employed with an antenna of the form shown in FIG. 1 or an antenna of the form shown in FIGS. 2, 3 and 4. It also should be noted that while the antenna illustrated in FIGS. 2, 3 and 4 is of the type with a metal grid 8 forming the reflective surface, there are satellite antenna dish structures which have a solid dish rather than a grid-like dish and the satellite antenna dish cover of the present invention may also readily be employed with the solid form of parabolic antenna dish which is formed of plastic or similar material.

The detailed structure of satellite antenna dish cover 11 is better shown in FIGS. 2, 3 and 4 where it will be seen that the preferred form is not a single piece of fabric or other sheet material as indicated in FIG. 1, but rather is formed of four pieces essentially in the shape of quadrants of a circle which are joined together along seams 37 which may be made by sewing the fabric together or made by use of adhesive or heat fusing to form seams 37. The fabric of sheet 13 is preferably a polyester fabric of knitted (or woven) form having a thread count of approximately 35 per inch and a weight of approximately four ounces per square yard. Yarn for knitted fabric may be from 40 to 200 denier. Fabric with from 10 to 100 threads per inch and weights of one to ten ounces could be employed, if desired. Preferably the material is at least moderately stretchable, that is, a one foot square piece of the fabric is stretchable by 2% by a force of not more than 10 pounds. It is contemplated and preferred that the unstretched configuration of the satellite antenna dish cover will be flat and that its conformation to the pyramidal or cone-like shape shown in FIG. 2 will be attained by the stretching of the fabric. However, should it be desired to form an antenna cover particularly for the antenna with multiple support elements 7 as shown In FIGS. 2, 3 and 4, one could readily make the angle of each of the four pieces combined to achieve the circular shape a few degrees less than 90° to produce an antenna dish cover with a generally conical shape before stretching. Also, the satellite antenna dish cover could be formed of a single piece of fabric or other sheet material, provided that it was available in a width sufficient to avoid piecing the material together. Alternatively, the material could be pieced together to attain the necessary width in any other fashion including one or more vertical seams or a fewer or greater number of sectors than the four shown In FIG. 2 and FIG. 3.

A decorative pattern as shown in FIG. 1 may be applied to the fabric by any coating, printing, or dying method, but preferably a sheet transfer printing process is used to impregnate dye into the fabric fibers.

More detailed construction of the preferred form antenna cover 11 may be seen in FIG. 4. Antenna cover 11 wraps around circular tubing element 2 of the antenna dish, overlapping the back of antenna dish by about six inches as shown in FIG. 4. This would be about the expected degree of overlap for a twelve foot diameter cover on an eleven foot diameter dish; there would be greater overlap on small antennas. Hem 15 on the outer edge of cover 11 may be formed by a double row of stitching 16, or an alternative means of securing the two layers of fabric together may be utilized in place of double stitching 16.

A cord 17 is threaded through the hem 15 (preferably about one-half to two inches in width) for holding the cover 11 in place. Cord 17 may be formed of nylon or any suitable synthetic or natural fiber and preferably should withstand a tensile force of at least 150 pounds; a synthetic plastic fiber cord of one-eighth to one-quarter inch is suitable for cord 17. Cord 17 may be of a stretchable material but such a characteristic is not necessary for cord 17.

A cutout of about six to twelve inches in width in the edge of cover 11 provides an opening 18 which preferably has an edging formed by a binding 19 fastened with double stitching 20. Binding 19 may be of the same or heavier fabric as cover 11 or may be a heavier fabric or plastic sheet material. Opening 18 allows cord 17 to extend from hem 15 in a convenient manner where it is secured to a cord tightening device 21 having a frame 23 and a spool 25 mounted therein to which both ends of cord 17 are connected. Cord tightening device 21 is a conventional readily available item and is operated to tighten and tension cord 17 by rotation of handle 26 whereby the ends of cord 17 are wrapped on spool 25. The arrangement shown in FIG. 4 has both ends of cord 17 connected at their ends to spool 25, but one could equally well secure only one end of cord 17 to spool 25 and secure the other end of cord 17 to the nonrotating frame 23 of cord tightening device 21. Handle 26 is provided with a ratchet element 27 which is engaged by a pawl 28 pivotally mounted on pin 30; spring 29 urges pawl 28 into engagement with ratchet 27 facilitating the tightening of cord 17 by tightening device 21. Pawl 28 also prevents unintentional unwinding and loosening of cord 17.

From the foregoing description It will be seen that the invention provides a seasonal decorative cover for a satellite antenna dish with little or no loss of reception while permitting changing the appearance of the antenna dish from an unsightly one to a decorative one. Furthermore, the appearance can be selected and/or changed to coordinate with Halloween, Christmas or other holidays, or to present a sports team motif. In accordance with the invention a decorator design may be applied to a relatively light weight fabric which may be treated to make it weather and mildew resistant and UV radiation resistant. A vast majority of satellite antenna dish styles may be accommodated by either a twelve foot diameter Cover or an eight foot diameter cover which by reason of the drawstring or drawcord and hem provides a variable overlap of the cover on the back of the dish thereby permitting use of that particular cover size for a substantial range of dish diameters.

The bound, preferably circular, opening approximately twelve to fourteen inches in diameter in the center of the cover allows the antenna feed and receiving device to protrude through the cover and also provides a wind vent tending to reduce the wind forces on the cover and the antenna dish.

Installation is done by placing the decorative cover on the satellite, allowing the central receiving device to protrude through the center opening. On the back side of the satellite, tile overlapping, decorative cover will be pulled tightly with the use of a strong, light weight cord drawstring. The two ends of the drawstring will be captured in an opening provided in the spool of the tightening device or otherwise secured to the spool. Rotating the winding handle and the spool of the tightening device puts substantial tension on the cord preventing the cover from being displaced from the antenna dish. The ratchet and locking mechanism for the spool of the tightening device thus secures the drawstring and decorative cover to the dish antenna.

The satellite antenna dish cover will produce with a flat surface decorative cover or a slightly cone shaped decorative cover depending on the structure of the satellite. If it is a satellite antenna with one center rod protruding from the center of the dish with a receiving device attached at the end of this rod, the surface of the cover will be flat. If it is a satellite antenna with three or four braces attached at the side of the antenna dish angling to the center to support the receiving device, the cover will be slightly cone shaped. In either case, the stretchability of the fabric will cause the cover to assume a smooth wrinkle-free surface.

Two sizes of decorative covers accommodate many different sizes of satellite dishes, and each decorative cover will overlap the dish edge so that it can be secured on the back side of the dish. A twelve foot decorative cover will cover dishes eleven, ten, nine and eight feet in diameter (or any other dimension between eight and eleven feet), overlapping the back of the dish six inches to two feet. An eight foot decorative cover will cover dishes seven, six, five and four feet In diameter, also overlapping in back of the dish from six inches to two feet. Preferably the decorator design will have a solid color or solid pattern for about two and one-half feet around the outer edge of the cover so that the smaller satellites will have virtually the same decorator design appearance as do the larger satellites.

While the specific form of satellite antenna dish cover shown and described is the best currently known form of cover for carrying out the purpose of the invention, such purpose can be carried out by substantially different forms of covers. For example, the relatively large central opening in the cover should be altered to be a partially reclosable opening or of different shape or other alterations could be made to accommodate the various forms of antenna feed and receiver support structures. Clearly, the particular form of spool-type cord tightening device illustrated and described could be replaced by any one of numerous forms of such devices, such as ball-locking pull-tites or the drawcord could simply be manually pulled tight and tied with a knot. Woven synthetic fabric is the preferred cover material, but knitted fabric or solid or perforated plastic sheet may be employed.

While the hem and drawcord form attachment of the cover has numerous advantages, including accommodation of antennas of different sizes, the primary advantage of the antenna cover could be achieved in part for one size of antenna by the use of U-clips riveted or otherwise secured to the edge of the cover in sufficient number to maintain the cover in place when the clips were snapped over the edge of the antenna dish.

In addition to the variations and modifications to the satellite antenna cover of the invention which have been shown, described or suggested, other variations and modification will be apparent to those skilled in the art, and accordingly, the scope of the invention is thought to be considered limited to the embodiments and variations thereof which have been described or suggested but is rather to be determined by reference to the appended claims.

What is claimed is:

1. A cover for a satellite communication receiver antenna dish having a concave side comprising:

a sheet of non-transparent flexible material of generally circular outline no more than twelve feet in diameter;

said sheet having folded portions around the periphery thereof forming an enclosure for a drawcord, said enclosure having at least one interruption for exit of ends of a drawcord;

a drawcord threaded through said enclosure having ends extending from said at least one interruption;

a cord tightening device having a spool engageable by at least one of said ends of said drawcord; and means for rotating and for restraining rotation of said spool, whereby said cover, when said drawcord is relaxed, may be placed over said concave side of said antenna dish which has a diameter somewhat less than said cover, after which, said drawcord may be tightened by rotation of said spool to capture the rim of said dish with the periphery of said cover, following which, restraint of said spool will fasten said cover securely over said dish opening to substantially conceal the dish behind the visible non-transparent cover.

2. A cover as recited in claim 1 wherein said sheet is a fabric sheet having at least ten threads per inch.

3. A cover as recited in claim 1 wherein substantially the full periphery of said sheet is folded back on itself at least about one-half inch and secured near its edge to form a hem serving as said enclosure.

4. A cover as recited in claim 1 wherein said at least one interruption is formed by a generally U-shaped cutout at the periphery of said sheet.

5. A cover as recited in claim 4 wherein said cutout is provided with a binding around the edge thereof.

6. A cover as recited in claim 5 wherein said means for rotating and for restraining said spool includes a handle and a ratchet secured for rotation with said spool, said cord tightening device includes a frame, and said frame has a spring loaded pawl which engages said ratchet.

7. A cover as recited in claim 2 wherein substantially the full periphery of said sheet is folded back on itself at least about one-half inch and secured near its edge to form a hem serving as said enclosure.

8. A cover for a satellite communication receiver antenna dish having a concave side comprising:

a sheet of non-transparent flexible material at least three feet and no more than twelve feet in its greatest transverse dimension and having a central opening therein from six inches to sixteen inches in maximum diameter;

said cover having at least one retaining element for a drawcord positioned around the periphery of said sheet, substantially the full periphery of said sheet being folded back on itself at least about one-half inch and secured near its edge to form a hem serving as said at least one retaining element;

a drawcord encircling said sheet retained by said at least one retaining element and having two ends in proximity near the periphery of said sheet; and a tightening device for drawing said cord ends to tension to reduce the drawcord periphery to substantially less than the maximum cover periphery, whereby said cover, when said drawcord is relaxed, may be placed over the concave side of said antenna dish which has a transverse dimension somewhat less than said cover with the receiver unit of said antenna element extending at least partially through said central circular opening, after which said drawcord may be tightened by said tightening device to capture the rim of said dish with the periphery of said cover, thereby to fasten said cover over said dish opening to substantially conceal the dish behind the visible surface of the non-transparent cover.

9. A cover as recited in claim 8 wherein said tightening device includes a spool, a handle and a ratchet secured for rotation with said spool, said tightening device includes a frame, and said frame has a spring loaded pawl which engages said ratchet.

10. A cover as recited in claim 8 wherein said hem has an interruption formed by a generally U-shaped cutout at the periphery of said sheet.

11. A cover for a satellite communication receiver antenna dish having a concave side comprising:

a sheet of non-transparent flexible, stretchable fabric of generally circular outline at least six feet and no more than twelve feet in diameter;

said sheet having a folded hem portion around the periphery thereof for enclosing a drawcord, said hem portion having at least one interruption for exit of ends of a drawcord;

a drawcord threaded through said hem portion and having ends extending from said at least one interruption; and a tightening device engageable to said ends of said drawcord;

whereby said cover, when said drawcord is relaxed, may be placed over said concave side of said antenna dish which has a diameter somewhat less than said cover, after which, said drawcord may be tightened by employment of said tightening device to capture the rim of said dish with the drawcord in the hem of said cover to fasten said cover securely over said dish opening to substantially conceal the dish behind the visible non-transparent cover.

12. A cover as recited in claim 11 wherein substantially the full periphery of said sheet is folded back on itself at least about one-half inch and secured near its edge to form a hem serving as said enclosure.

13. A cover as recited in claim 11 wherein said at least one interruption is formed by a generally U-shaped cutout at the periphery of said sheet.

14. A cover as recited in claim 13 wherein said cutout is provided with a binding around the edge thereof.

15. A cover as recited in claim 11 wherein said tightening device includes a spool, means for rotating and for restraining said spool including a handle and a ratchet secured for rotation with said spool, and a frame, said frame having a spring loaded pawl which engages said ratchet.

* * * * *